United States Patent [19]

Mitchell

[11] 4,046,206

[45] Sept. 6, 1977

[54] LOCKING APPARATUS FOR EARTH BORING CUTTER OR STABILIZER

[75] Inventor: Howard Earl Mitchell, Duncanville, Tex.

[73] Assignee: Dresser Industries, Inc., Dallas, Tex.

[21] Appl. No.: 676,956

[22] Filed: Apr. 14, 1976

[51] Int. Cl.[2] ..... E21B 9/24

[52] U.S. Cl. ..... 175/364; 175/53

[58] Field of Search ..... 175/361-370, 175/347, 374, 53; 308/8.2

[56] References Cited

U.S. PATENT DOCUMENTS

| | | | |
|---|---|---|---|
| 3,216,513 | 11/1965 | Robbins et al. | 175/364 X |
| 3,601,207 | 8/1971 | Coski et al. | 175/364 |
| 3,612,196 | 10/1971 | Dixon | 175/364 |
| 3,705,635 | 12/1972 | Conn | 175/364 |
| 3,835,944 | 9/1974 | Bingham | 175/347 |
| 3,851,718 | 12/1974 | Fink | 175/364 X |

*Primary Examiner*—Ernest R. Purser
*Assistant Examiner*—Richard E. Favreau
*Attorney, Agent, or Firm*—Eddie E. Scott

[57] ABSTRACT

The rolling cutter or stabilizer member of a rotary drill string unit is effectively locked in place by a locking device. The device allows the cutter or stabilizer member to carry radial, tangential and axial loads. A support member includes a surface positioned perpendicular to the resultant of the expected radial load and tangential load. A support shaft includes a slabbed-off surface positioned perpendicular to the resultant of said resultant loads and said axial load.

5 Claims, 5 Drawing Figures

LOCKING APPARATUS FOR EARTH BORING CUTTER OR STABILIZER

BACKGROUND OF THE INVENTION

The present invention relates in general to the art of earth boring and more particularly to a locking apparatus for an earth boring cutter or stabilizer.

The rolling formation contacting member of an earth boring bit or drill string stabilizer must be easy to assemble, must lock firmly in place during operation and should be easy to disassemble. The bit or stabilizer generally operates under severe conditions and is subject to the corrosive forces of the drilling environment. In addition, the bit or stabilizer must be adapted to withstand heavy loading and high torque.

The rotatable cutters of an earth boring bit are often positioned between a pair of support arms extending from the body of the bit. A journal assembly extends between the support arms and secures the cutter to the main body. The cutters have a useful lifetime that is much shorter than the lifetime of the bit. Consequently, means must be provided to allow the cutters to be changed. The heavy loading and high torque encountered during the drilling operation, as well as the corrosive drilling environment, complicates the problem of providing a cutter that will remain firmly in place during drilling yet may easily be changed.

DESCRIPTION OF PRIOR ART

In U.S. Pat. No. 3,705,635 to William M. Conn patented Dec. 12, 1972, a large diameter earth boring bit is shown. The rolling cutters of the large diameter earth boring bit are locked in place in a saddle mount yet may easily be removed. A vee-shaped, slabbed-off portion of the journal is held in place by a cap bolted to the saddle mount.

In U.S. Pat. No. 3,612,196 to Robert L. Dixon patented Oct. 12, 1971, a rock-boring cutter is shown. The cutter assembly is particularly adapted for use on headplates of rock-boring tools wherein a plurality of cutters are closely positioned end-to-end. The cutters are supported by journals having restricted endwise movement in their mouths and the mouths including journal end receiving saddles and clamping means releaseably overlying the journal ends to permit removal of the journals and the cutters mounted thereon away from the headplate in a direction transversely of the journals.

In U.S. Pat. No. 3,921,734 to Robert D. Goodfellow patented Nov. 25, 1975, a raise boring head and rolling cutter arrangement therefor is shown. The raise boring head includes a plurality of rolling cutters distributed over the head including circumferentially spaced gage cutters. Each cutter has a rotatable part and a support shaft supporting the rotatable part with the ends of the support shafts carried in saddles fixed to the body of the raise boring head. Each end of each support shaft is formed to a rectangular shape and fits into a rectangular slot in the respective saddle and is secured therein as by bolts. The radially outer sides of the saddles for the gage cutters are provided with hard wear resistant inserts to reduce the wear thereon.

SUMMARY OF THE INVENTION

The present invention provides a simple and effective means of locking a rotatable cutter member or stabilizer member onto the mounting means of a rotary drill string unit. The cutter or stabilizer member can be easily and quickly changed using simple hand tools. The cutter or stabilizing locking apparatus will carry radial, tangential and axial loads. A cap means is removeably affixed onto the mounting means. The cap means is positioned perpendicular to the resultant of the expected radial and tangential loads. The mounting means includes a support shaft with a slabbed-off surface positioned perpendicular to the resultant of the expected resultant radial load and axial load. The above and other features and advantages of the present invention will become apparent from a consideration of the following detailed description of the invention when taken in conjunction with the accompanying drawings.

DETAILED DESCRIPTION OF THE INVENTION

Figure 1:
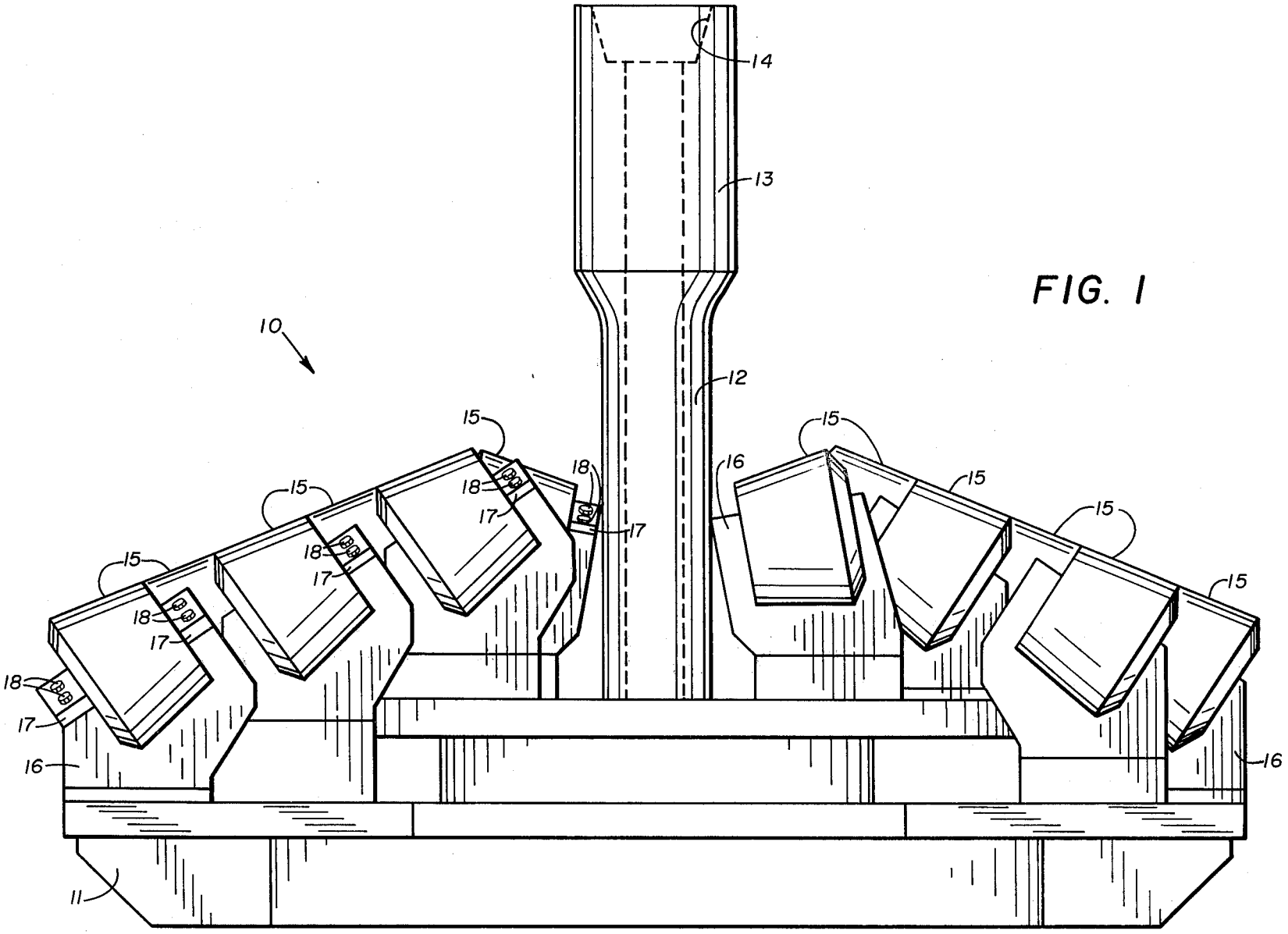
FIG. 1 is a side view illustration of a bit constructed in accordance with the present invention.

Referring now to FIG. 1, a side view of a raise bit constructed in accordance with the present invention and generally designated by the reference number 10 is shown. The raise bit 10 includes a raise bit body 11 or cutter stage body and a drive stem 12. The upper portion of the drive stem 12 is enlarged to form a stabilizer section 13. The raise bit 10 is adapted to be connected to a rotary drill column by a threaded connection 14. A multiplicity of rolling cutters 15 are mounted in a corresponding multiplicity of saddles 16. The saddles 16 extend from the raise bit body 11.

The raise bit 10 is used in a raise drilling operation to provide a relatively large diameter hole from a first mine level to a second mine level. The raise drilling operation begins by drilling a small diameter pilot hole through the earth from a first location to an opening at a second location using a small diameter pilot bit. After the pilot hole is completed, the pilot bit is removed from the drill column and the raise bit 10 is attached to the drill column. The raise bit 10 is rotated and drawn along the pilot hole thereby enlarging the pilot hole to the desired size.

Difficulty has been encountered in providing adequate bearing support for the rotating cutters of the large diameter bit 10. The bearing must be securely locked in place during drilling and must include means for releasing the cutters from the saddles to allow a change of cutters. The present invention solves the foregoing problem by providing the journal of the cutter or the journal of a stabilizer element with a support surface and cap means wherein the support surface is perpendicular to the resultant of the expected radial and tangential loads. The support shaft includes a surface slabbed at an angle to the center of the support shaft. The slabbed-off surface is perpendicular to the resultant of the resultant radial load and axial load. In addition, the support surface is machined on the mounting device or is installed on the drilling framework at an angle in the direction of rotation of the entire drilling framework. This angle is skewed with respect to a line which passes through the center of rotation of the cutter and is perpendicular to the formation. This skew angle is a function of the expected radial to tangential loads.

Figure 2:
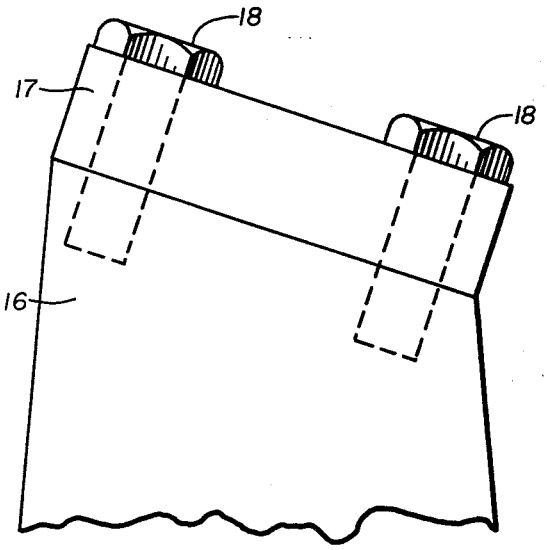
FIG. 2 is an end view of a mounting and locking apparatus constructed in accordance with the present invention.

Referring now to FIG. 2, an end view of one of the mounting saddles 16 is shown. The saddle 16 includes an upper portion that is skewed so that it is perpendicular to the resultant of the expected radial load and expected axial load. A cap 17 is mounted on this upper portion. The cap 17 is connected to the saddle 16 by a pair of bolts 18.

Figure 3:
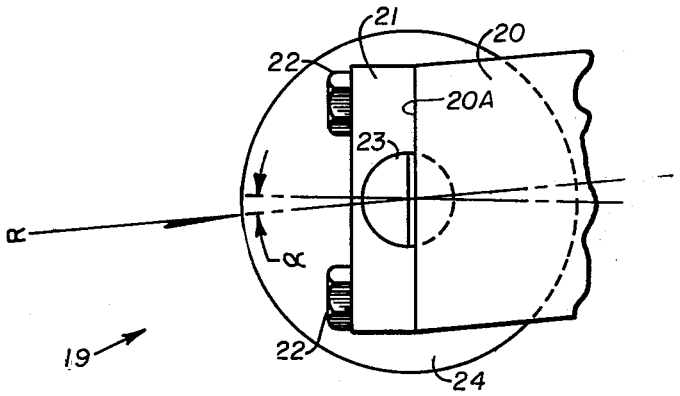
FIG. 3 is an end view of another embodiment of the present invention.

Referring now to FIG. 3, an end view of another embodiment of a mounting and locking apparatus constructed in accordance with the present invention is illustrated. The rolling member and mounting and locking apparatus are collectively designated by the reference number 19. The rolling member 24 could be either a rolling stabilizer element or an earth boring cutter. The rolling member 24 is mounted in a saddle 20 by a pair of bolts 22. The mounting surface 20A of the saddle 20 is skewed so that it is perpendicular to the resultant of the expected radial load and expected axial load. The mounting surface 20A, as shown in FIG. 3, is a planar surface extending perpendicular to the resultant of the expected radial load and expected axial load. A cap 21 is positioned over the saddle 20 that securely locks the support shaft 23 in place. The cap 21 is connected to the saddle 20 by a pair of bolts 22.

At rest, the cutter 24 would receive a static radial load R. This radial load would be perpendicular to the longitudinal axis of the arm of the saddle 20. However, when the bit or drill string element is being rotated, the dynamic radial load would not act perpendicular to the longitudinal axis of the arm of the saddle 20. Instead, the dynamic radial load would be an angle $\alpha$ to the central axis of the arm of the saddle 20. The dynamic radial load is the resultant of the radial load expected to be applied to the rolling member 24 and the tangential load expected to be applied to the rolling member 24. The mounting surface of the saddle 20 is positioned perpendicular to the dynamic radial load, i.e. the resultant of the expected radial load and expected tangential load. For purposes of understanding the invention the expected tangential load is the component of the load acting tangent to the rolling member 24 perpendicular to the central axis of the arm of the saddle 20 and the expected radial load is the component of the load acting along the central axis of the arm 20.

Figure 4:
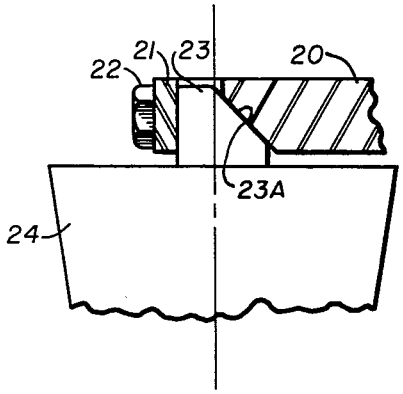
FIG. 4 is a side view of the mounting and locking apparatus shown in FIG. 3.

Referring now to FIG. 4, a side view of the embodiment 19 is shown. The support shaft 23 includes a slabbed-off end surface 23A that mates with a matching surface on the arm of the saddle 20. The slabbed-off surface is positioned perpendicular to the resultant of the expected dynamic radial load and the expected axial load. The axial load is the load which acts along the axis of the support shaft 23.

Figure 5:
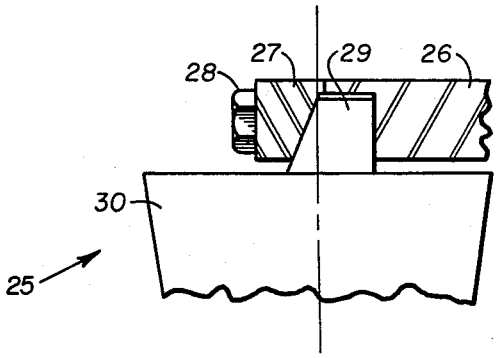
FIG. 5 illustrates still another embodiment of the present invention.

Referring now to FIG. 5, another embodiment 25 of the invention is shown. A rolling member 30 is positioned to rotate about a shaft 29, the shaft 29 is supported by an arm 26. A cap 27 is positioned over the arm 26 and held in place by a bolt 28. The end of the shaft 29 includes a slabbed-off surface that mates with a surface on the inside of the cap 27. In this embodiment the radial load is carried by the outer surface of the shaft 29 which fits within a matching curved recess in the arm 26. The axial load is carried by the slabbed-off surface and matching surface on the inside of the cap 27. The arm 26 is mounted on the body of the bit or drill string unit with the central axis of the arm aligned with the resultant of the expected radial load and expected tangential load. This is contrasted with the embodiments shown in FIGS. 1-4 wherein the central axis of the arm is not aligned with the dynamic radial load, but wherein the surface of the arm is skewed to the central axis of the arm so that the upper surface of the arm is perpendicular to the resultant of the expected radial load and expected tangential load. It will be appreciated that in both embodiments the upper surface of the arm will be perpendicular to the dynamic radial load.

The structural details of three embodiments of the present invention having been described the operation of the embodiments will now be considered. The radial load expected to be carried by the rolling member is first determined. This can be calculated by determining the total thrust load to be applied to the drilling unit and allocating the thrust load to the individual rolling members. Next, the expected tangential load is determined. This can be calculated by determining the RPM of the drilling unit, the distance the rolling member is from the central axis of the rotating unit, and the earth formations expected to be encountered. Once the expected radial load and the expected tangential load are known, the resultant of the two is determined by a trigonometric analysis. The support arm is then constructed so that its upper surface is perpendicular to the resultant. This can be done by either skewing the upper surface of the arm or by having the entire arm aligned with the resultant. Next, the axial load expected to be carried by the rolling member is determined. This can be calculated by analyzing the geometry of the rolling member and the geometry of the bit or drill string element. Once the expected axial load is known, the resultant of the dynamic radial load (the resultant from the foregoing calculations) and the expected axial load is determined by a trigonometric analysis. A slabbed-off portion of the support shaft is then machined so that it will be perpendicular to said resultant. The rolling member is effectively locked in place and adapted to carry the radial load, tangential load, and axial load with maximum efficiency. The rolling member may be removed and replaced easily and quickly using simple hand tools.

The embodiments of the invention in which an exclusive property or privilege is claimed are defined as follows:

1. A locking apparatus for a rotary drill string unit, said rotary drill string unit having a longitudinal axis of rotation and including a support member, a support shaft carried by said support member and a rolling member positioned on said support shaft with said rolling member adapted to receive an expected radial load and an expected tangential load as said rotary drill string unit is rotated, comprising:

a support surface on said support member for supporting said support shaft, said support surface being positioned so that it forms an acute angle to a plane passing through said longitudinal axis of rotation measured in the direction of rotation of said rotary drill string unit, said support surface being substantially perpendicular to the resultant of said expected radial load and said expected tangential load; and cap means for locking said support shaft to said support member, said cap means removeably affixed to said support surface.

2. A locking apparatus for a rotary drill string unit, said rotary drill string unit including a support member, a support shaft carried by said support member and a rolling member positioned on said support shaft with said rolling member adapted to receive an expected radial load, an expected tangential load, and an expected axial load, comprising:

a support surface on said support member for supporting said support shaft, said support surface being positioned substantially perpendicular to the resultant of said expected radial load and said expected tangential load;

a slabbed-off surface on said support shaft for contacting said support surface, said slabbed-off surface being substantially perpendicular to the resultant of said axial load and said resultant of said expected radial load and said expected tangential load; and cap means for locking said support shaft to said support member, said cap means removeably affixed to said support surface.

3. A locking apparatus for a rotary head of an earth boring machine, said rotary head having a longitudinal axis of rotation and including a saddle with at least one support arm, a support shaft positioned on said support arm and a rolling cutter mounte on said support shaft, with said rolling cutter adapted to receive an expected radial load and an expected tangential load as said rotary head is rotated, comprising:

a support surface on said support arm for supporting said support shaft, said support surface being positioned so that it forms an acute angle to a plane passing through said longitudinal axis of rotation measured in the directon of rotation of said rotary head, said support surface being substantially perpendicular to the resultant of said expected radial load and said expected tangential load; and cap means removeably affixed to said support surface, thereby locking said shaft on said support arm.

4. A locking apparatus for a rotary head of an earth boring machine, said rotary head including a saddle with at least one support arm, a support shaft positioned on said support arm and a rolling cutter mounted on said support shaft, with said rolling cutter adapted to receive an expected radial load, an expected tangential load, and an axial load, comprising:

a support surface on said support arm for supporting said support shaft, said support surface being positioned substantially perpendicular to the resultant of said expected radial load and said expected tangential load;

a slabbed-off surface on said support shaft for contacting said support surface, said slabbed-off surface being substantially perpendicular to the resultant of said axial load and said resultant of said expected radial load and said expected tangential load; and cap means removeably affixed to said support surface, thereby locking said shaft on said support arm.

5. The locking apparatus of claim 4 wherein said support surface is skewed on said support arm.

* * * * *